US005078630A

United States Patent [19]

Katsumata

[11] Patent Number: 5,078,630

[45] Date of Patent: Jan. 7, 1992

[54] ENGINE COOLING SYSTEM INDUCTION ARRANGEMENT FOR MARINE INBOARD-OUTBOARD AND OUTBOARD ENGINES

[75] Inventor: Takeshi Katsumata, Hiratsuka, Japan

[73] Assignee: Nissan Motor Co., Ltd., Japan

[21] Appl. No.: 426,272

[22] Filed: Oct. 25, 1989

[30] Foreign Application Priority Data

Oct. 28, 1988 [JP] Japan ..... 63-140769[U]

[51] Int. Cl.[5] ..... B63H 21/26

[52] U.S. Cl. ..... 440/88; 440/89

[58] Field of Search ..... 440/88, 78, 75, 89

[56] References Cited

U.S. PATENT DOCUMENTS

| | | | |
|---|---|---|---|
| 2,549,484 | 4/1951 | Kiekhaefer | 440/78 |
| 2,847,967 | 8/1958 | Kiekhaefer | 440/88 X |
| 2,948,252 | 8/1960 | Alexander, Jr. | 440/89 X |
| 3,025,824 | 3/1962 | Foster | 440/88 X |
| 3,164,121 | 1/1965 | Alexander, Jr. | 440/88 |
| 3,447,504 | 6/1969 | Shimanckas | 440/75 |
| 3,943,790 | 3/1976 | Meyer | 440/78 X |

FOREIGN PATENT DOCUMENTS

| | | |
|---|---|---|
| 50-124394 | 9/1975 | Japan . |
| 55-103336 | 2/1982 | Japan . |
| 62-283097 | 12/1987 | Japan . |

*Primary Examiner*—Sherman Basinger
*Attorney, Agent, or Firm*—Leydig, Voit & Mayer

[57] ABSTRACT

A marine outboard engine has a section of its cooling water suction passage defined by an annular groove formed in the periphery of a bearing housing which accommodates the bearing of the propeller shaft. This allows the suction passage to be connencted to a water intake formed on a lower section of the torpedo of the engine without the need to increase the size of the torpedo. This results in a smaller, lighter configuration for the lower case while still allowing the engine to be operated in a super high mount operating mode which is appropriate for use with a super cavitation propeller, due to the low position of the cooling water intake.

12 Claims, 14 Drawing Sheets

ENGINE COOLING SYSTEM INDUCTION ARRANGEMENT FOR MARINE INBOARD-OUTBOARD AND OUTBOARD ENGINES

BACKGROUND OF THE INVENTION

1. Field of the Invention

The present invention relates generally to a marine inboard-outboard or outboard engine. More specifically, the present invention relates to an improved water intake arrangement for an inboard-outboard or outboard engine. Still more specifically, the present invention relates to an improved water intake arrangement for inboard-outboard and outboard engines whereby the induction of cooling water into the cooling water circuit of the outboard engine can be performed efficiently regardless of the operating mode and in a manner which allows the outboard engine to be operable in a high setting mode and permit the use of a high performance super cavitation propeller, and in a shallow water mode wherein the outboard engine is partially tilted so as to permit the boat on which it is mounted, to be operated in very shallow water.

2. Description of the Prior Art

In prior art marine outboard and inboard-outboard engines it is common to employ what is referred to as a "wet" cooling system wherein, rather than recirculating a given amount of coolant through a heat exchanger system as is usually performed in automotive engines, cooling water is introduced from the body of water in which the vessel is floating, into the cooling water circuit of the outboard engine and then discharged back into the body of water, usually through the exhaust port of the outboard engine.

The induction system of the outboard engine shown in FIGS. 1-4 by way of example is disclosed in detail in JP.A.57-30691.

In FIG. 1 an exemplary outboard engine 5 having a so called "wet" type prior art cooling water induction system is depicted in a side elevational view. The outboard engine 5 is mounted on the boat, which it is intended to drive, by means of a clamp 4 which is attached to a bracket 3 formed at the upper portion of the transom 2.

The outboard engine 5 includes a torpedo 6 at the lower portion of the lower case 7, in which the gears by which the rotation imparted to the drive shaft 12 by the power unit 11 is transmitted to the propeller, are accommodated. The lower case 7 comprises a water intake 8 formed immediately above the torpedo 6 for the induction of water from the body of water in which the vessel is floating, into the cooling circuit of the outboard engine. The water drawn in through the water intake 8 is forced through the cooling circuit under pressure by means of a water pump 9. This pump is disposed within the lower portion of the upper case 10, in the immediate vicinity of the drive shaft 12 so as to be driven thereby.

The details of the torpedo 6 and the lower case 7 will be better appreciated from a consideration of FIGS. 2, 3 and 4.

As can be seen from FIG. 2, the torpedo 6 formed at the bottom of the lower case 7 accommodates pair of gears 13 by which the rotation of the drive shaft 12 imparted thereto by the power unit 11, is transmitted to the propeller shaft 14. A propeller boss 15 on which are formed propeller blades 16, is mounted on the propeller shaft 14 so as to be driven thereby.

The propeller shaft 14 extends rearwardly from the drive shaft 12 and is approximately parallel to the surface of the water. The forward end of the propeller shaft 14 is seated against a thrust bearing 50 which receives the forward thrust imparted to the propeller shaft 14 by the action of the blades 16 of the propeller as it is driven to rotate in the water.

The propeller shaft 14 in maintained in alignment within the torpedo 6 by means of the thrust bearing 50 and a bearing 18 which is formed in the vicinity of the gears 13. At the rear end of the torpedo 6, a bearing 19 is provided for further maintaining the propeller shaft 14 in alignment. An oil seal 51 is provided at the rearmost end of the casing for retaining lubricant and excluding water.

The bearings 18 and 19 are formed at opposite ends of a bearing housing 17 which is received in a cylindrical chamber 20 defined within the torpedo 6. The bearing housing 17 is sealed against the walls of the cylindrical chamber 20 at its front end and is narrowed at its central portion such as to define an empty space within the cylindrical chamber 20 of the torpedo 6. This empty space is fluidly communicated to the lower end of the outboard engine exhaust passage 21 which formed in the lower case 7 and thus defines the most downstream portion of the engine exhaust passage.

A water intake 8 is formed in the wall of the lower case 7 immediately above the torpedo 6. This water intake 8 is connected, by means of the suction passage 22, to the water pump 9 which serves to drive the water under pressure through a discharge water passage 23 and into the internal cooling circuit of the power unit 11.

However, this prior art system suffers from a number of drawbacks which prevent the operation of the same in given modes of operation as will become more clearly appreciated from the following discussion.

In FIG. 5 the outboard engine having the prior art induction arrangement, is depicted in the normal operation mode. As will be appreciated in this mode, the lower case 7 is arranged to project deeper than the bottom of the boat 1. Accordingly, even if the boat is in a condition wherein the bottom is riding on the top of the water surface 24 as occurs when the boat is planing, the water intake 8 of the outboard engine 5 is disposed well beneath the surface of the water so that an ample supply of cooling water can be easily inducted through the water intake 8.

However, it is now required to be able to operate outboard engines and the like, in modes not previously contemplated.

Among these "new" operating modes is, for example, the "shallow water" operation mode in which the outboard engine is set high in the water so as to avoid impinging on underwater obstacles thereby effectively decreasing the draft of the boat and allowing it to be operated in shallower waters.

Another of these operation modes is the "high setting" mode in which a high performance "super cavitation" propeller of the type in which only one or two of the blades is in the water at any given time is employed.

In these operating modes the outboard engine 5 is set at a level at which the upper surface of the torpedo 6 is actually at or above the water surface 24. In FIG. 6 the high set mode in which the upper surface of the torpedo 6 and the propeller boss 15 are level with the water surface is shown. In FIG. 7 the high set mode in which the upper surface of the torpedo 6 and the propeller boss 15 are actually above the water surface is shown.

FIG. 8 shows the above mentioned shallow water mode wherein the outboard engine is partially or half tilted and set for shallow water operation in a manner to avoid the bottom and/or submerged obstacles.

As can be seen, in the high setting and shallow water modes, the water intake 8 of the prior art outboard engine is located well above the water surface 24. Under these circumstances only air is inducted through the water intake 8 and the cooling system becomes "starved" of liquid coolant. This of course leads to rapid overheating and/or severe damage to the power unit 11.

What is more, even when the prior art outboard engine 5 is operated in the normal mode in which the cooling water intake 8 is disposed well below the water surface 24, there is still the possibility of cooling water induction problems.

For example, it is not uncommon in the operation of such craft that a piece of floating matter 25 such as a sheet of material such as a discarded vinyl sheet, becomes draped across the front of the lower case 7 in the manner shown in FIG. 9. In such cases the vinyl sheet 25 may cover the water intake 8 and be held firmly thereagainst by the suction produced by the water pump 9 thereby partially or completely blocking the flow of coolant water to the water pump 9 and again raising the danger that the outboard engine becomes starved of coolant and overheats.

In view of the above problems encountered in outboard engines wherein the water intake 8 is disposed on the side of the lower case 7 at a portion thereof which is located immediately above the torpedo 6, it has been proposed to form a water intake at a lower portion of the torpedo. FIG. 10 shows an example of such an arrangement.

In the FIG. 10 arrangement the 26 is located in the water intake front surface of the skeg which protrudes from the bottom of the torpedo 6. The water intake 26 is connected to the water pump 9 by a suction passage 27 which is formed at the front edge portion of the lower case. Thus, the water intake 26 is always immersed in water no matter what the operation mode of the outboard engine is.

However, this particular proposal encounters drawbacks which render it difficult to put into idea into actual practice.

These difficulties arise from the fact that, as can be appreciated from FIG. 2, a number of elements must be disposed in the limited space at the front portion of the torpedo and in its immediate vicinity. Among these are the speedometer pickup 49, the shift rod 28 and the thrust bearing 50. Thus, in practice it becomes difficult or impossible to arrange the water intake in the vicinity of the front of the torpedo because of the crowding with other essential engine elements.

One proposal for overcoming the overcrowding at the front portion of the lower case 7 is to form a cup-shaped cap on the front of the torpedo 6 in which a passage is formed for allowing the induction of cooling water.

In such a construction however, the nose cone added to the front of the torpedo poses certain disadvantages in itself in that it adds weight to the outboard engine and can have a negative effect on the overall balance of the same. Another disadvantage of such an added on nose cone is that it would protrude from the front of the torpedo 6 thus making it more likely for floating matter, such as seaweed and the like, to become caught on the front edge of the lower case 7 instead of sliding down and off of the bottom of the lower case as tends to occur in the absence of such a protrusion.

It has also been proposed in the prior art to integrally form a slightly larger nose cone at the front of the torpedo.

However, in accordance with such a design, the above problems wherein floating matter can become caught on the nose cone because it protrudes beyond the front edge of the lower case and is therefore not easily and naturally dislodged remain, while the problems that the lower case becomes generally larger and heavier, still also remain unsolved.

Examples of the above proposed nose cone water intakes are set forth in JP.A.62-283097 and JP.A.50-124394.

BRIEF SUMMARY OF THE INVENTION

In view of the difficulties encountered with the water intake arrangement of the prior art as set forth above it is an object of the present invention to provide a novel water intake arrangement by which the cooling water can be drawn into the cooling circuit of an outboard $ or inboard outboard engine dependably regardless of the setting position of the engine and which achieves this goal without adding to the overall size of the torpedo, and what is more, without adding to the overall weight of the engine thereby preserving the balance of the engine.

It is another object of the instant invention to provide a water intake arrangement for use in an outboard engine which is simple in construction and does not add to the cost of producing the outboard engine.

It is still a further object of the instant invention to provide a water intake arrangement for use in an outboard engine in which the tendency for the port to become clogged due to floating matter, is reduced.

It is yet another object of the instant invention to provide a water intake arrangement which facilitates the operation of the outboard or inboard.outboard in a high setting mode suitable for the efficient operation of a super cavitation propeller.

In brief, the above objects are achieved by a marine inboard-outboard or outboard engine which has a section of its cooling water suction passage defined by an annular groove formed in the periphery of a bearing housing which accommodates the bearings of the propeller shaft. This arrangement allows the suction passage to be connected to a water intake formed on a lower section of the torpedo of the engine without the need to increase its size. This results in a smaller lighter configuration for the lower case while still allowing the engine to be operated in a super high mount operating mode which is appropriate for use with a super cavitation propeller due to the low position of the cooling water intake.

More specifically, the present invention is deemed to comprise a marine engine having a cooling water circuit in which a cooling water pump is provided for pumping cooling water therethrough, and which features: a propeller shaft defining propeller shaft axis; a bearing housing for accommodating a bearing of the propeller shaft so as to allow it to rotate therewithin about the axis; a bearing housing defining a chamber having a cylindrical inner wall, the bearing housing being fitted against a portion of the wall so as to form a seal; an annular groove formed in one or both of the periphery of the bearing housing and the wall of the bearing housing a cooling water suction passage connected at one end to the intake of the cooling water pump and at the other end thereof to the annular groove; and a water intake, formed at a portion of the marine engine that is lower than the propeller shaft axis for drawing water from a body of water in which the lower portion of the marine engine is disposed.

BRIEF DESCRIPTION OF THE DRAWINGS

FIG. 8 is a side elevational view of a marine outboard engine formed with a cooling water intake arrangement according to the prior art, mounted on the transom of boat and arranged in the "shallow water" position so as to avoid contact with underwater obstacles and the like;

DETAILED DESCRIPTION OF THE PREFERRED EMBODIMENTS

Figure 11:
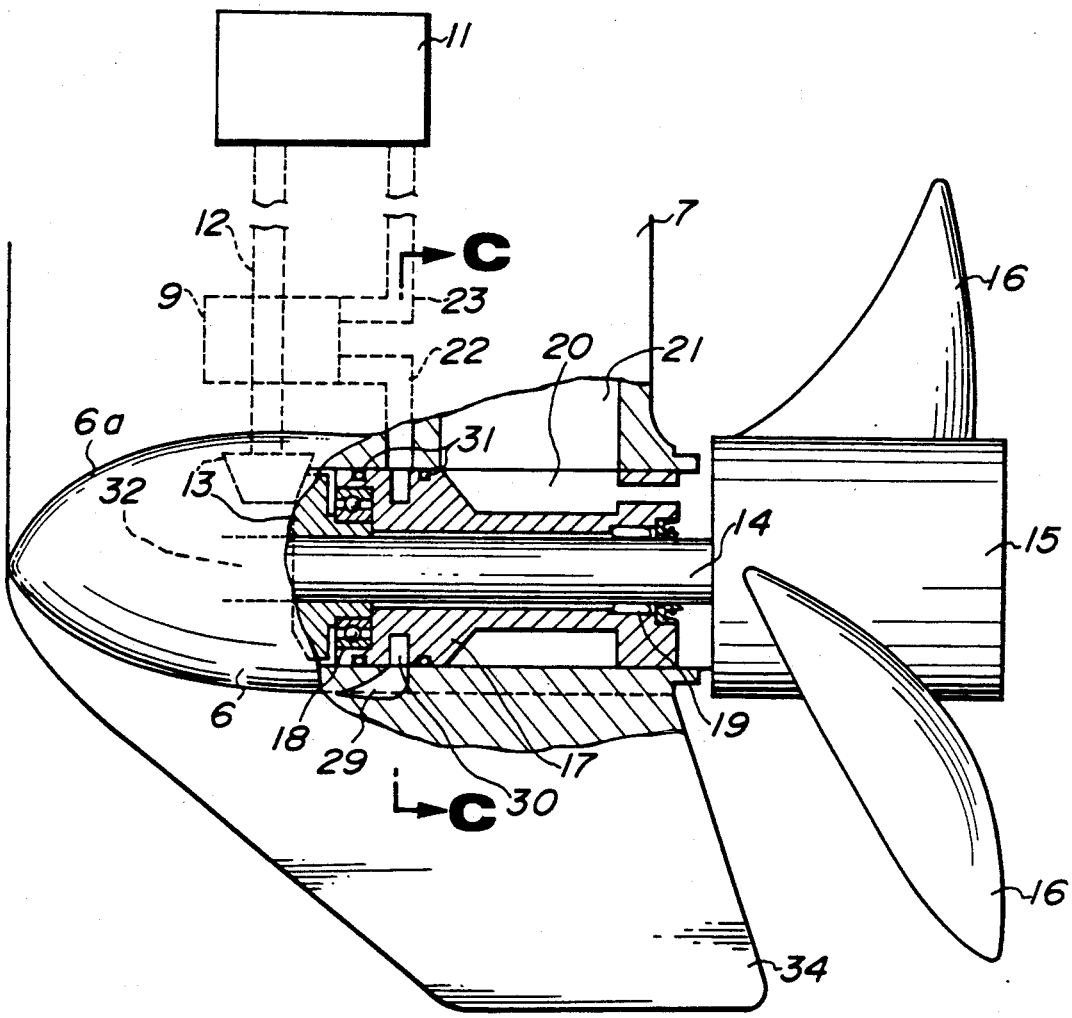
FIG. 11 is an enlarged partial cutaway side elevation view of the lower portion of the marine outboard engine formed with a cooling water intake arrangement according to the first preferred embodiment of the present invention, which shows the water intake and its relationship to the other essential features of the lower case.

FIG. 11 shows a first embodiment of the present invention. In this embodiment a torpedo 6 is, as shown, formed at the bottom of the lower case 7.

The torpedo 6 comprises an essentially cylindrical section extending about two thirds of its length the interior of which forms the cylindrical chamber 20 in which the bearing housing 17 is accommodated.

A water intake 29 is formed in the lower side of the torpedo in the vicinity of the front end of the bearing housing 17.

Further, the water intake 29 is has a scoop shape and is set to face into the upper stream so as to induct the coolant water into the annular groove 30.

Figure 12:
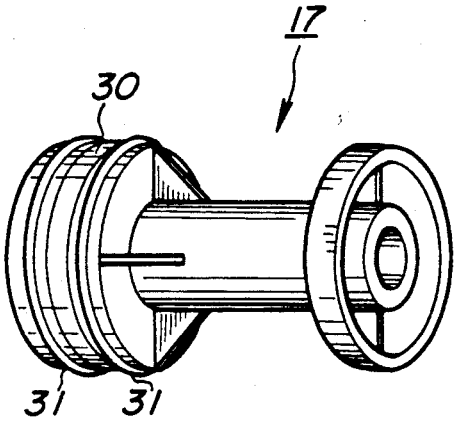
FIG. 12 is a perspective view in which the bearing housing of the outboard engine shown in FIG. 11 and comprising an annular groove for defining a section of the cooling water suction passage, is shown.

The bearing housing 17 formed in accordance with the first preferred embodiment of the instant invention and depicted in perspective in FIG. 12, comprises an annular groove 30 formed in the large diameter portion at the front end thereof which engages the walls of the cylindrical chamber 20. The water intake 29 is formed at the bottom of the lower case 7 and connects at its inner end with the annular groove 30 formed in the bearing housing 17. At its upper side the annular groove 30 formed in the bearing housing connects to the lower end of the suction passage 22.

Thus, the annular groove 30 of the bearing housing 17 in cooperation with the inner walls of the cylindrical chamber 20 of the torpedo 6 serves to define the lower portion of the suction passage.

It will be further noted that, in the bearing housing further comprises a pair of O-ring seals 31 provided at either side of the annular groove 30 for sealing the suction passage formed by the groove from the gear chamber 32 in which the gears 13 and their lubricant are accommodated. Thus, the suction passage is sealed from the oil containing gear chamber 32 defined at the front portion of the torpedo 6 so as to prevent the cooling water inducted into the cooling circuit of the engine through the annular chamber from becoming mixed with the oil in the gear chamber 32.

The annular groove 30 is also sealed from the exhaust gases expelled into the open section of the cylindrical chamber 20 formed around the narrow central section of the bearing housing 17 so as to prevent the introduction of air and other non-condensible gasses into the cooling water circuit of the power unit 11.

Figure 13:
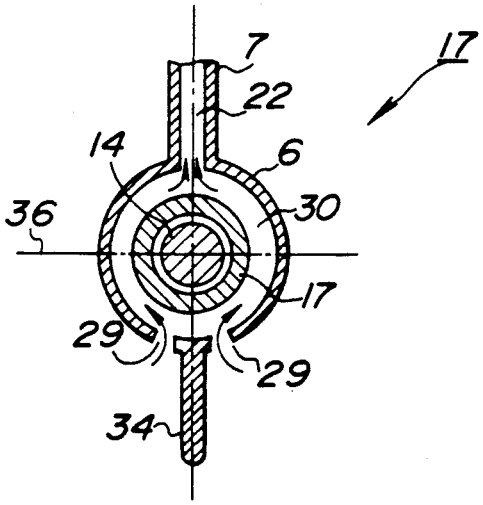
FIG. 13 is a cross sectional view of the lower portion of the marine outboard engine formed with a cooling water intake arrangement according to the prior art shown in FIGS. 11 as taken along section line C—C.

Thus, as set forth above and as will be further appreciated from FIG. 13, which is a cross-sectional view of the torpedo 6 and the lower portion of the lower case 7 taken along the line C—C of FIG. 11, the water intakes 29 are formed at either side of the skeg 34 projecting along the center line at bottom of the lower most portion of the torpedo 6, so as to draw water through the suction passage defined by the annular groove 30 formed in the bearing housing 17 along the induction path indicated by the arrows in the drawing.

The water is drawn from the lowermost portion of the torpedo 6, through the annular groove 30 formed by the groove in the outer periphery of the bearing housing 17 and the inner walls of the inner cylindrical chamber 20 of the torpedo 6 and the suction passage 22 formed in the lower case 7, into the intake of the cooling water pump 9 from whence it is driven under pressure into the cooling circuit of the power unit 11 through the discharge passage 23.

Details of the operation of the cooling water induction system formed in accordance with the present invention while the inboard or inboard.outboard engine is operated in various operational modes shall hereinafter be given with reference to FIGS. 14, 15, 16, 17, and 18.

Figure 14:
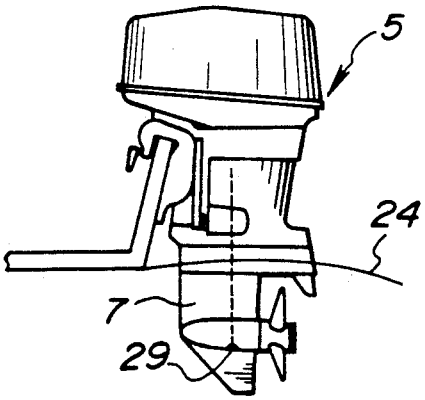
FIG. 14 is a side elevational view of a marine outboard engine formed with a water intake arrangement according to the first embodiment of the instant invention, mounted on the transom of the boat and arranged in a "normal position" wherein the boat is planing.

As will be appreciated from FIG. 14, when the outboard engine 5 having a water intake arrangement formed in accordance with the first preferred embodiment is operated in the normal operating mode the water intake 29 is submerged well beneath the water surface 24, cooling water can be easily inducted into the water intake 29 of the outboard engine 5 by means of the suction generated by the water pump 9.

Figure 1:
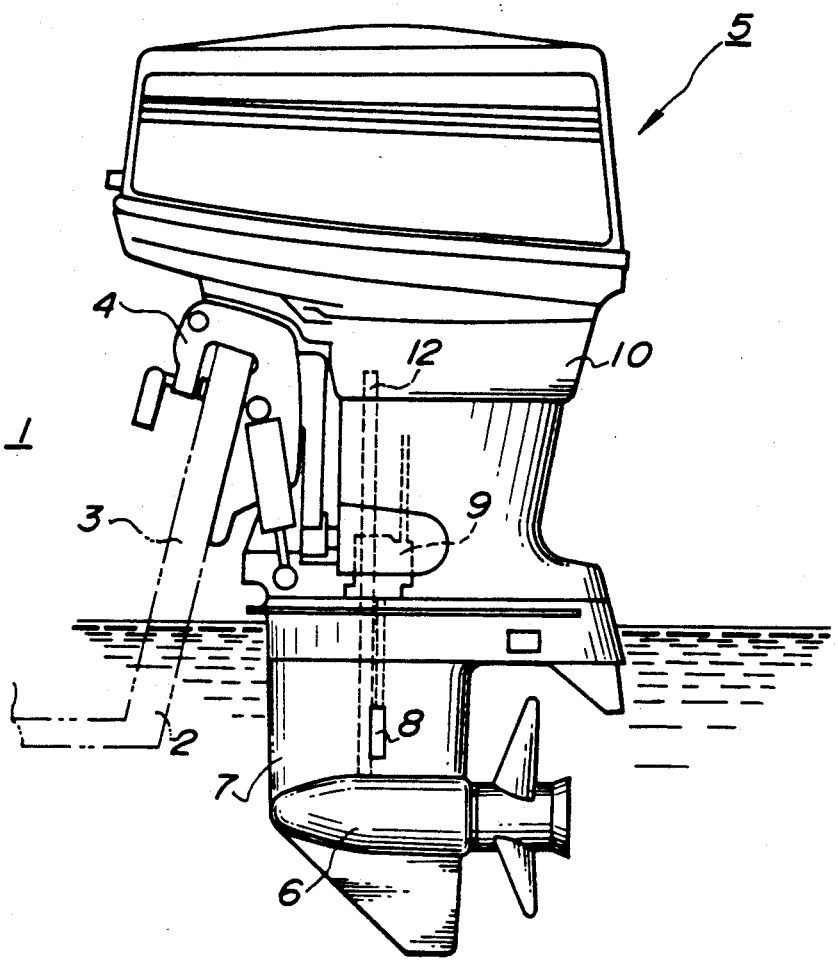
FIG. 1 (PRIOR ART)
FIG. 1 is a side elevational view of a marine outboard engine formed with a water intake arrangement according to the prior art, and which shows the engine disposed on the transom of a boat and arranged in the "normal position"
Figure 2:
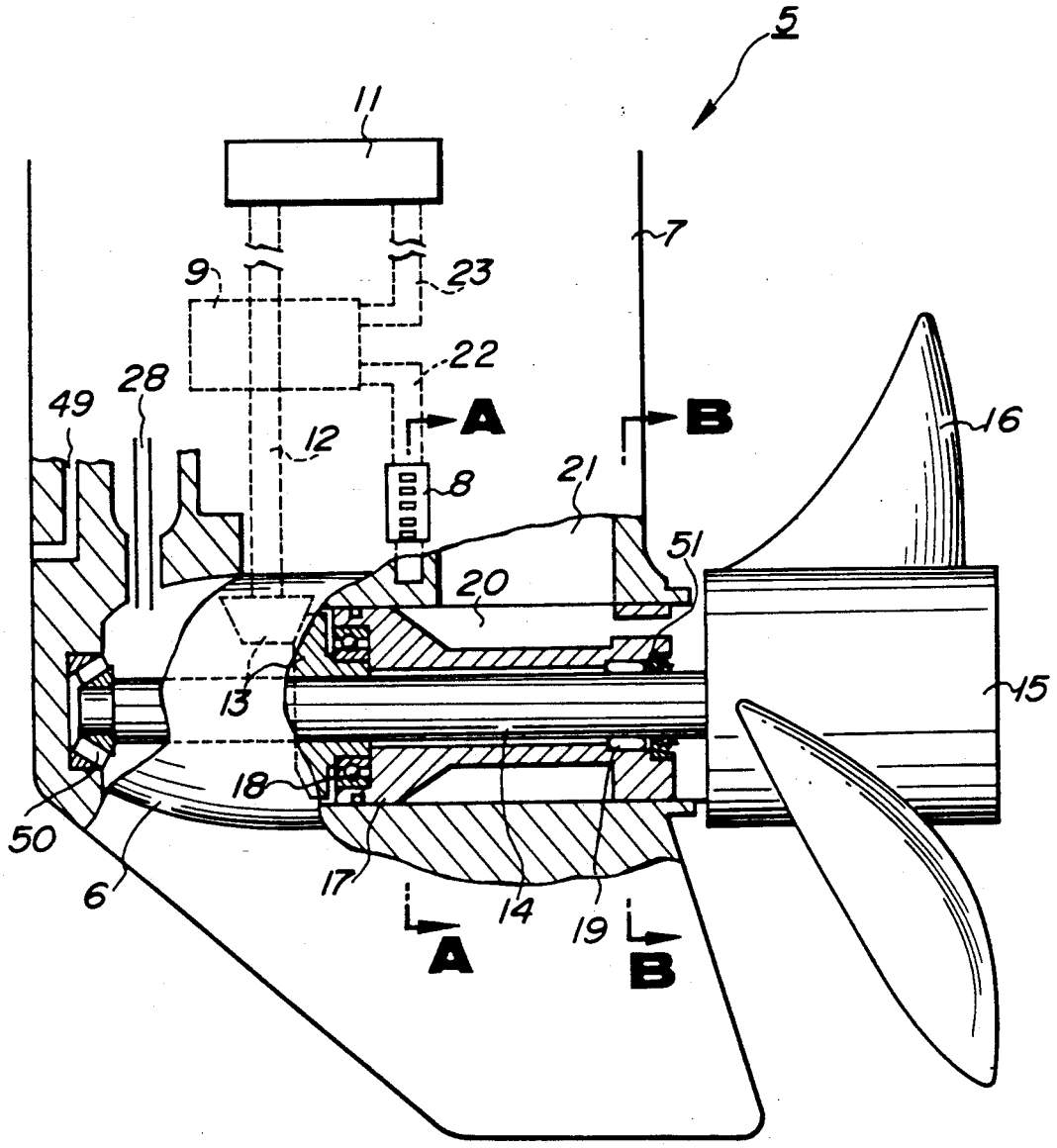
FIG. 2 (PRIOR ART)
FIG. 2 is an enlarged partial cutaway side elevation view of the lower portion of the marine outboard engine formed with a water intake arrangement according to the prior art shown in FIG. 1, illustrating the water intake and the essential features of the lower case.
Figure 3:
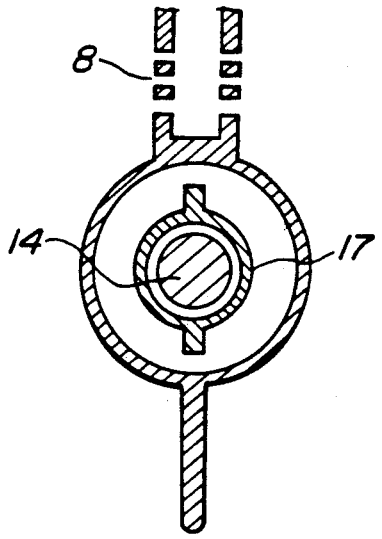
FIG. 3 (PRIOR ART)
FIG. 3 is a cross-sectional view of the lower portion of the marine outboard engine formed with a water intake arrangement according to the prior art shown in FIGS. 1 and 2, as taken along section line A—A of FIG. 2.
Figure 4:
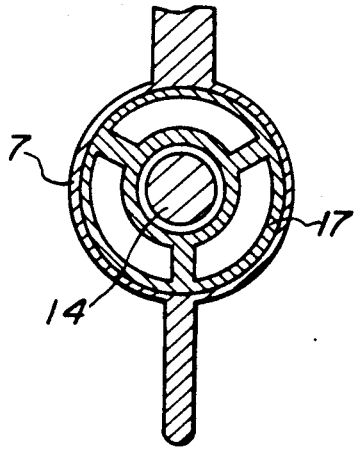
FIG. 4 (PRIOR ART)
FIG. 4 is a cross sectional view of the lower portion of the marine outboard engine formed with a water intake arrangement according to the prior art shown in FIGS. 1 and 2, as taken along the section line B—B of FIG. 2.
Figure 5:
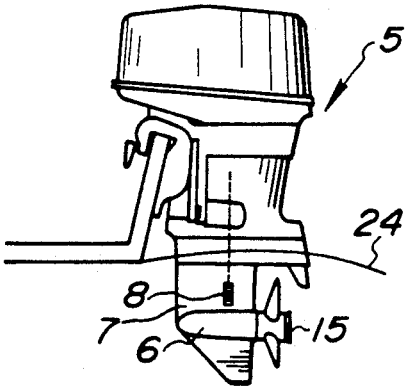
FIG. 5 (PRIOR ART)
FIG. 5 is a side elevational view of a marine outboard engine formed with a water intake arrangement according to the prior art, mounted on the transom of boat and arranged in the "normal position" wherein the boat is planing.
Figure 6:
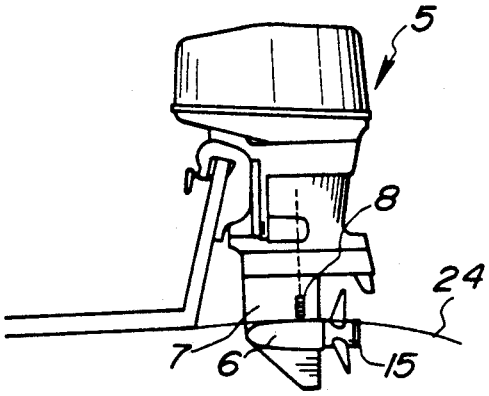
FIG. 6 (PRIOR ART)
FIG. 6 is a side elevational view of a marine outboard engine formed with a water intake arrangement according to the prior art, mounted on the transom and arranged in the "high mount" position wherein the boat is in a planing state.
Figure 7:
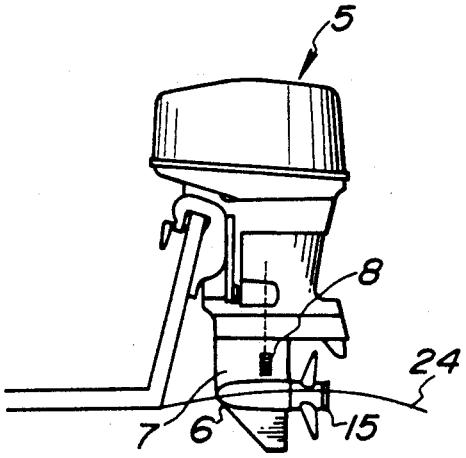
FIG. 7 (PRIOR ART)
FIG. 7 is a side elevational view of a marine outboard engine formed with a cooling water intake arrangement according to the prior art, mounted on the transom and arranged in the "super high mount" position wherein the boat is planing.
Figure 8:
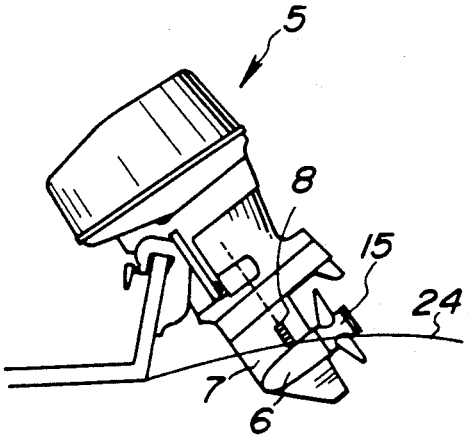
FIG. 8 (PRIOR ART)
Figure 9:
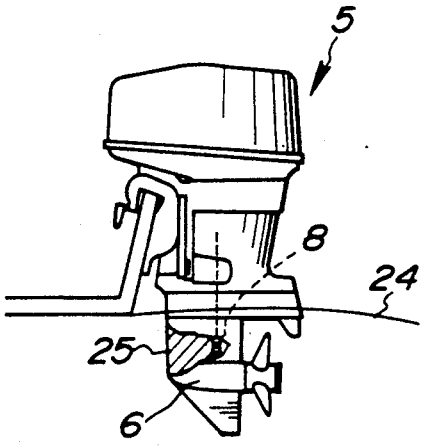
FIG. 9 (PRIOR ART)
FIG. 9 is a side elevational view of a marine outboard engine formed with a water intake arrangement according to the prior art, mounted on the transom and arranged in the "normal" position wherein the water intakes are obstructed by floating matter (see hatched area)
Figure 10:
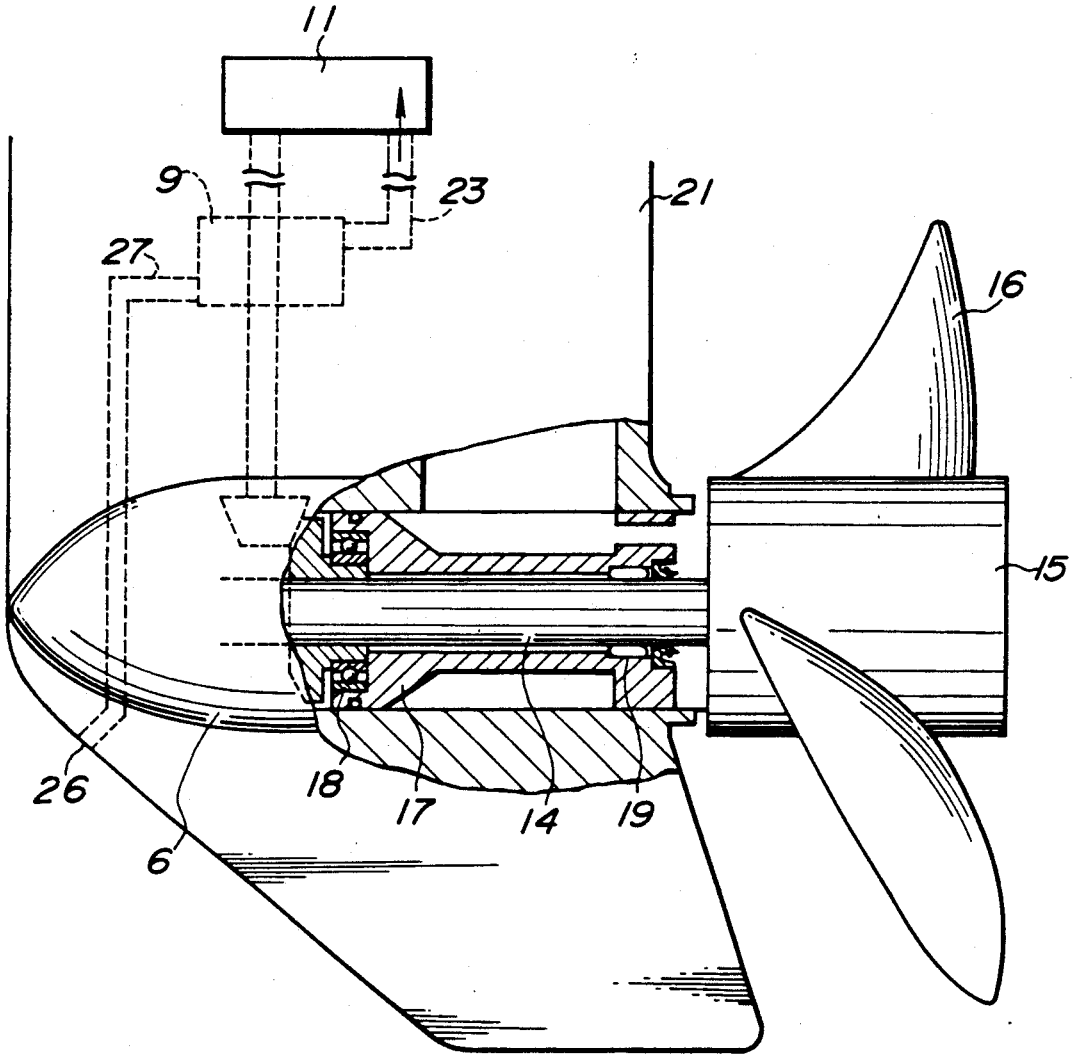
FIG.10 (PRIOR ART)
FIG. 10 is an enlarged partial cutaway side elevation view of the lower portion of the marine outboard engine wherein one of the proposals for overcoming the prior art water intake problem, is indicated in dotted lines.

In FIGS. 5 and 6 the outboard engine 5 having the water intake formed in accordance with the principles of the instant invention has been provided with a high performance super cavitation propeller 33 which is designed to operate most efficiently in a state wherein it is only partially submerged in the body of water in which the boat is being operated.

Figure 15:
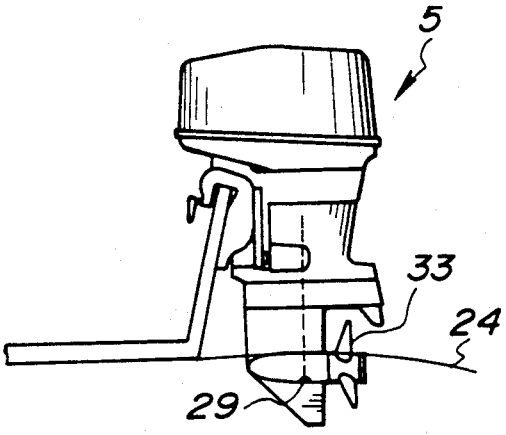
FIG. 15 is a side elevational view of a marine outboard engine formed with a water intake arrangement according to the first embodiment of the instant invention, mounted on the the transom of the boat and arranged in a "high mount" position wherein the boat is a planing state.
Figure 16:
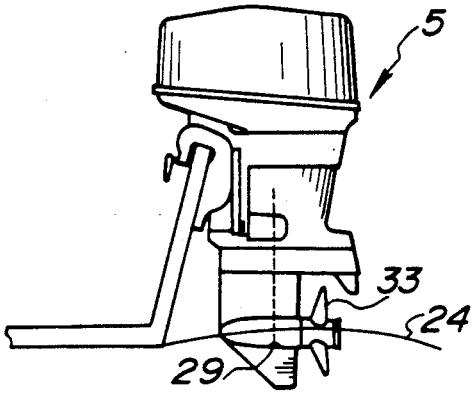
FIG. 16 is a side elevational view of a marine outboard engine formed with a water intake arrangement according to the first embodiment of the instant invention, mounted on the transom of the boat and arranged in a "super high mount" position wherein the boat is planing.

To facilitate the use of a super cavitation propeller 33, the outboard engine 5 has been set to the high setting position so that the upper side of the torpedo 6 and the boss 15 of the propeller 33 is level with the surface of the water in FIG. 16. In the super high setting mode shown in FIG. 15 the top of the torpedo 6 is above the surface of the water.

As will be appreciated from a consideration of FIGS. 15 and 16, when the outboard engine 5 having a water intake arrangement formed in accordance with the first preferred embodiment, is operated in the high setting mode, the water intake 29 is still submerged well beneath the water surface 24. Therefore, as in the normal operating mode shown in FIG. 14 the cooling water is again easily drawn into the water intake 29 of the outboard engine 5 by means of the suction generated by the water pump 9.

Figure 17:
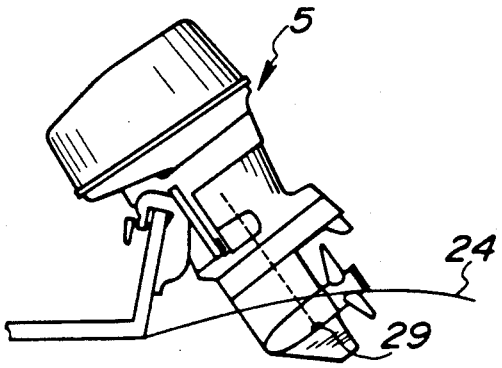
FIG. 17 is a side elevational view of a marine outboard engine formed with a water intake arrangement according to the first embodiment of the instant invention, mounted on the transom of boat and arranged in the "shallow water" position so as to avoid contact with an underwater obstacle.

In FIG. 17 the outboard engine 5 having the suction passage formed in accordance with the first embodiment of the instant invention is depicted while being operated in a so called "shallow water" mode. Viz., it is being operated in a state wherein it has been tilted up from the normal operating mode position shown in FIG. 14 so as to avoid contact with a shallow bottom portion of the body of water in which the boat is being operated.

As will be appreciated from a consideration of FIG. 17, when the outboard engine 5 having a water intake arrangement formed in accordance with the first preferred embodiment is operated in the shallow water mode, the water intake 29 is again submerged well beneath the water surface 24 and therefore, as in the normal operating mode shown in FIG. 14 the cooling water is again easily drawn into the water intake 29 of the outboard engine 5 by means of the suction generated by the water pump 9.

Thus, from the above disclosure and the accompanying drawings it may be appreciated that the outboard engine 5 provided with a cooling water intake arrangement according to the first embodiment of the instant invention, may be operated in any operating mode without the danger of insufficient cooling water being supplied into the cooling circuit of the engine and thus expose the engine to the risk of overheating and its accompanying dangers. Thus, it becomes possible to provide a simple outboard engine capable of operating a super cavitation propeller.

Further, in addition to the above advantages that the water intake formed in accordance with the instant invention is provided at a location on the engine body which is always submerged, the location of water intake 29 also has the advantage that since it located at the front side of the propeller in a straight cylindrical section of the torpedo 6 the water pressure at the water intake is very stable and is not subject to large fluctuations due to turbulence caused by the propeller. Furthermore. the streams of water at the positions of the water intake 29 is relatively free of bubbles. Also, since two water intake 29 are disposed on either side of the skeg 34 and are immediately adjacent thereto they are in a very constantly and stably directed stream of water. What is more, the lower position of the water intakes 29 relative to those of the prior art reduce the chances of the water intakes ports becoming exposed to the air due to wave action.

Figure 18:
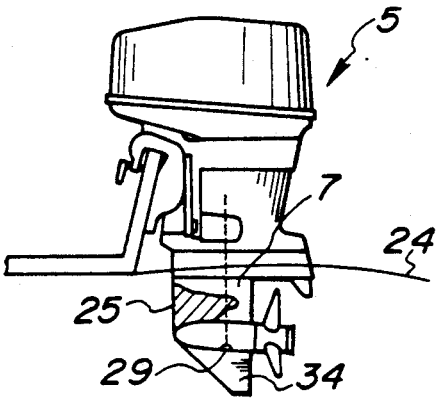
FIG. 18 is a side elevational view of a marine outboard engine formed with a water intake arrangement according to the first embodiment of the instant invention, mounted on the transom of the boat and arranged in the "normal" position wherein the positions of the prior art water intakes are obstructed by floating matter.

A further advantage of the location of the cooling water intakes according to the instant invention as can be appreciated from consideration of FIG. 18. As can be seen from FIG. 18, if during the passage of the boat through the water, a piece of floating matter 25 such as piece of a vinyl sheet should become caught on the front of the lower case 7 and is held draped thereacross by the flow of water, it cannot cause a reduction in the flow of water through the water intakes 9 as it wound have in the case of the water intakes 8 according to the prior art.

It will be noted that the water intakes 29 according to the invention are at a location which is not directly behind a vertical straight portion of the front edge of the lower case 7. Instead of being located behind said straight vertical section of lower case on which there would be a possibility that the flow of water would cause floating matter to cling, the water intakes 29 are located behind a section of the skeg 34 which is arranged at an angle to the flow of water such that floating matter impinging on the front of the skeg 34 is caused to be washed down and off and does not remain stuck clinging thereto.

It will further be noted that the water intakes 29 according to the first preferred embodiment invention are located in a corner defined between an essentially flat section of the skeg 34 and the cylindrical chamber of the torpedo 6 and not on a flat surface. Therefore, even if a piece of floating matter should become caught on the torpedo 6 it would still be difficult for it to seal off the water intakes 29 and prevent the induction of water into the engine.

Figure 19:
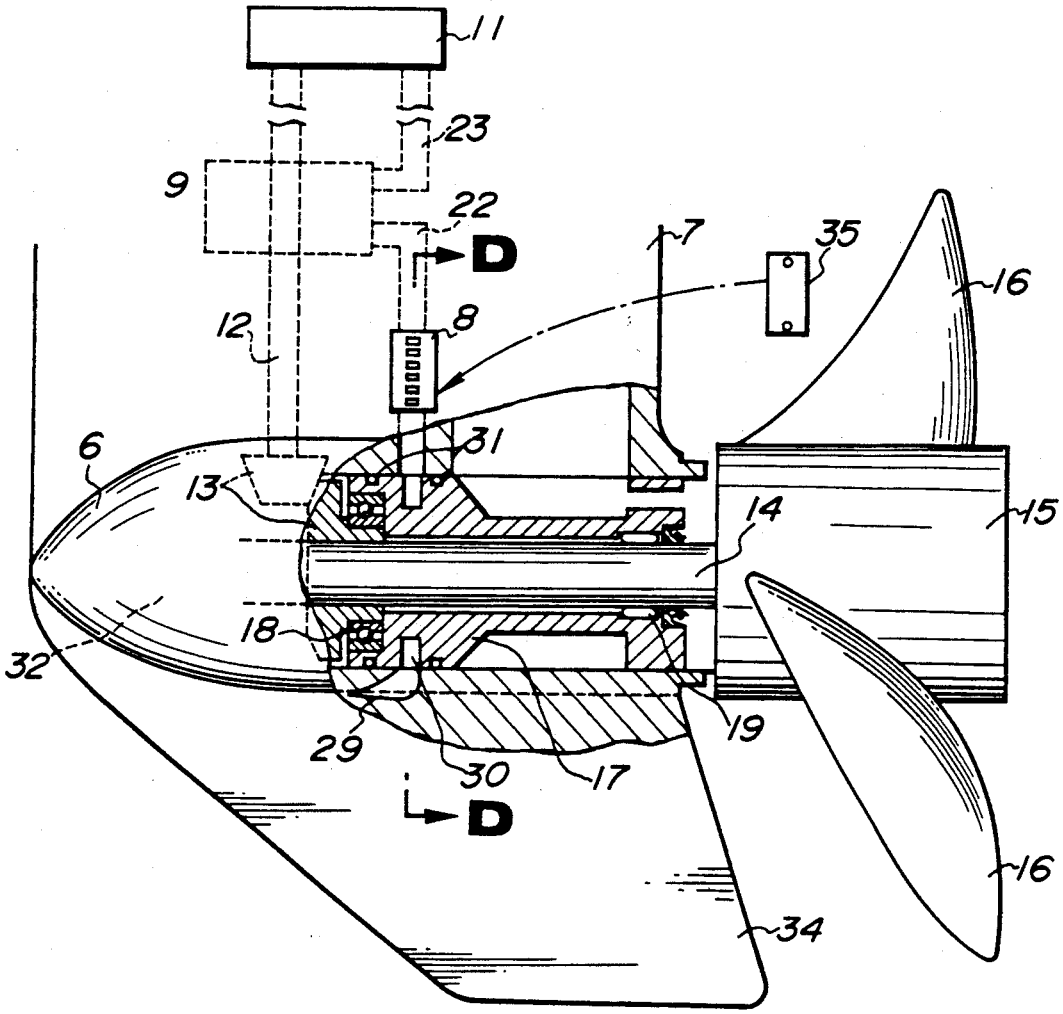
FIG. 19 is an enlarged partial cutaway side elevation view of the lower portion of the marine outboard engine formed with a water intake arrangement according to the second preferred embodiment of the present invention, showing the water intakes and their relationship to the other essential features of the lower case.

Now reference will be made to FIGS. 19 and 20 in which the lower portion of the second preferred embodiment of an outboard marine engine having a water intake system embodying the principles of the instant invention is depicted.

In the second preferred embodiment of the invention a prior art outboard engine having formed thereon the prior art water intake 8 as described above is modified so as to further include the water intakes 29 formed at the lower side of the torpedo 6.

Firstly a description will be made of the operation of the outboard engine 5 having a water intake system formed in accordance with the second embodiment of the instant invention.

Figure 21:
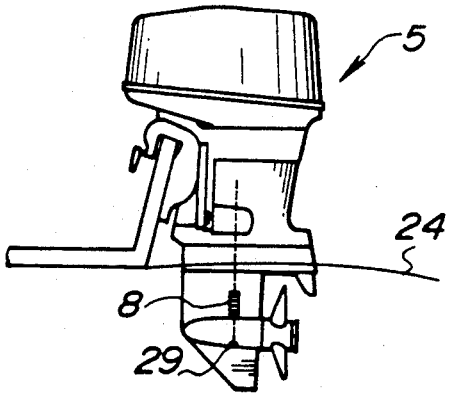
FIG. 21 is a side elevational view of a marine outboard engine formed with a water intake arrangement according to the second embodiment of the instant invention, mounted on the transom of the boat and arranged in the "normal position" wherein the boat is planing.

In FIG. 21 the outboard engine 5 is depicted in the normal operating mode wherein cooling water can be drawn into the engine's cooling water circuit through both the prior art water intakes 8 and the intake ports 29, as they are all beneath the surface 24 of the water. Thus, the outboard engine receives a free and ample flow of cooling water.

Figure 22:
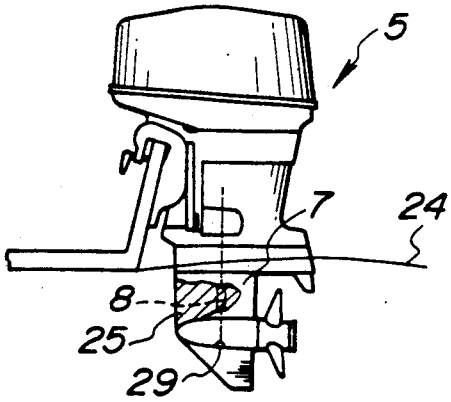
FIG. 22 is a side elevational view of a marine outboard engine formed with a water intake arrangement according to the first embodiment of the instant invention, mounted on the transom of the boat and arranged in the "normal" position wherein the water intakes are obstructed by floating matter.

When the engine 5 having the water intake system formed in accordance with the second embodiment is operated in the normal operating mode, and some floating matter such as a vinyl sheet 25 becomes lodged on the front of the lower case 7, and is held draped thereacross in such a manner as to obstruct the water intakes 8, and prevents the induction of cooling water therethrough, as in the manner depicted in FIG. 22, the lower water intakes 29 remain free of obstruction and serve to permit the induction of cooling water into the cooling circuit of the outboard engine 5. Thus, damage to the outboard engine 5 due to overheating is avoided.

Further, it will be noted that when the engine is operated in the normal mode the increased intake orifice area provided by the addition of the water intakes 29 according to the instant invention decreases the intake resistance and thus reduces the load on the water pump 9.

It will therefore be appreciated that the water intakes 29 provide a valuable enhancement of the dependability of the performance outboard engine 5 when provided in addition to the prior art type intakes ports 8.

Figure 23:
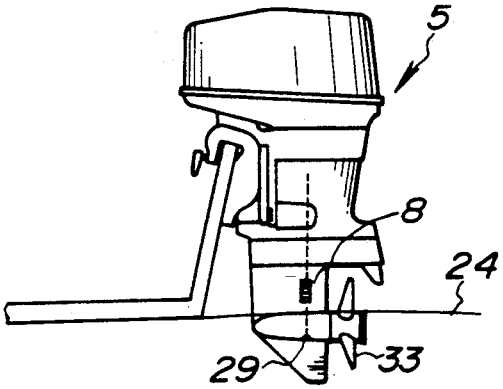
FIG. 23 is a side elevational view of a marine outboard engine formed with a water intake arrangement according to the second embodiment of the instant invention, mounted on the transom of the boat and arranged in the "high mount" position wherein the boat is a planing state.
Figure 24:
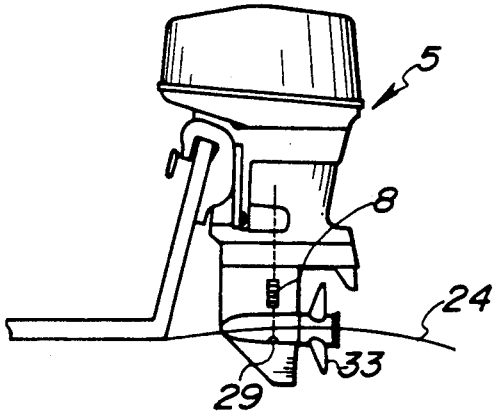
FIG. 24 is a side elevational view of a marine outboard engine formed with a water intake arrangement according to the second embodiment of the instant invention, mounted on the of transom of the boat and arranged in the "super high mount" position wherein the boat is planing.
Figure 25:
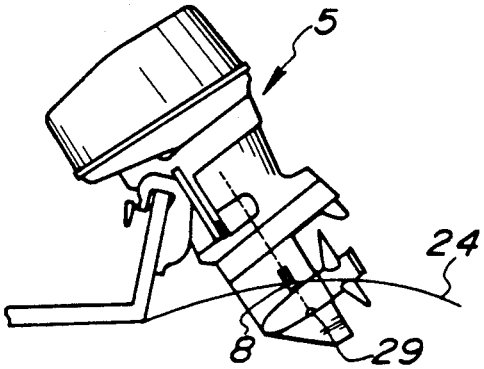
FIG. 25 is a side elevational view of a marine outboard engine formed with a water intake arrangement according to the second embodiment of the instant invention, mounted on the transom of the boat and arranged in the "shallow water" position so as to avoid contact with an underwater obstacle.
Figure 26:
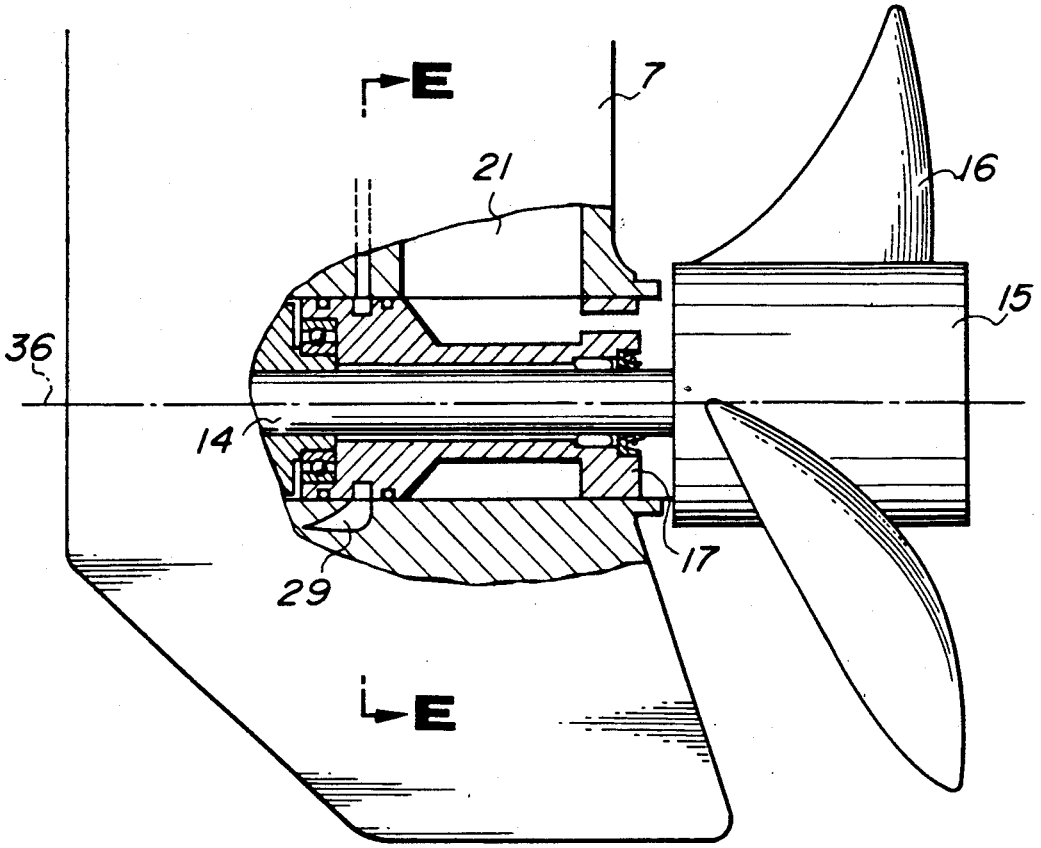
FIG. 26 is an enlarged partial cutaway side elevation view of the lower portion of the marine outboard engine formed with a water intake arrangement according to the third preferred embodiment of the present invention, showing the water intakes and their relationship to the other essential elements of the lower case.

The outboard engine 5 formed with the water intake arrangement according to the second embodiment of the invention provides a further advantage over the prior art water intake systems in that the engine may easily be modified so as to be operated in the high mount operation mode and/or in the (tilted) shallow water mode. Thus, the engine can be fitted with a super cavitation propeller 33, such as depicted in FIGS. 23 and 24. In cases where it is known that the engine 5 will be operated in the shallow water mode as depicted in FIG. 25 the engine can easily be set up accordingly.

Figure 20:
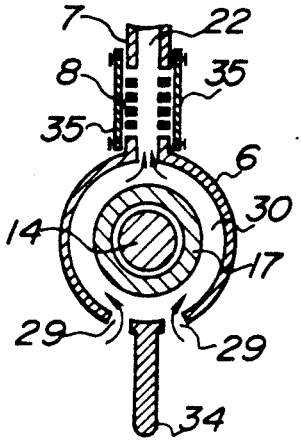
FIG. 20 is a cross sectional view of the lower portion of the marine outboard engine formed with a water intake arrangement according to the second preferred embodiment of the present invention, shown in FIG. 19 and taken along the line D—D of the same figure.

This modification to the water intake system of the engine 5 formed in accordance with the second embodiment of the invention consists of simply attaching covers 35 to the side of the lower case 7 in the manner shown in FIG. 20. In this manner the water intake ports 8 become sealed off. By sealing the water intake ports 8 by means of the cover 35 the upper intakes 8 are removed from the cooling water induction circuit.

While the covers 35 are disposed on the side of the lower case 7 so as to cover the water intakes 8 the induction of cooling water is restricted to the lower water intakes 29 formed at the bottom of the torpedo 6. These, as has been set forth previously, are positioned such that they remain below the surface 24 of the water in all operating modes of the engine 5 including the high mount and shallow water modes.

Therefore, even when the water intakes 8 are disposed above the surface 24 of the body of water in which the boat fitted with the outboard engine 5 is being navigated, no induction of air into the suction passage 22 occurs obviating the danger of the water pump 9 being caused to cavitate or run dry. Thus, the engine can be run in the high mount or shallow water modes without the danger of and shortage of liquid coolant and overheating.

Figure 27:
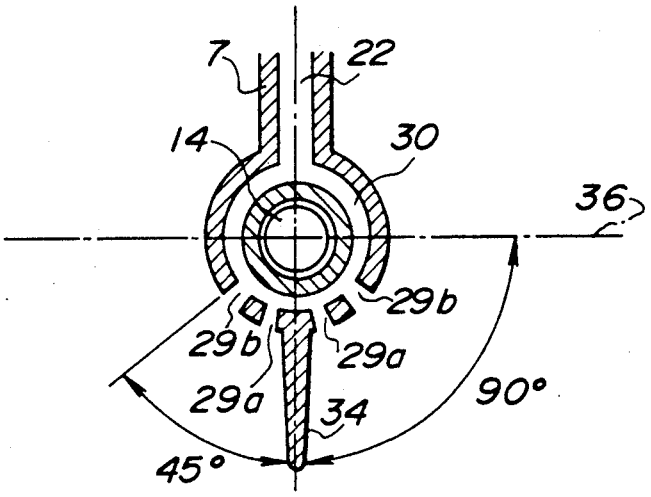
FIG. 27 is a cross-sectional view of the lower portion of the marine outboard engine formed with a water intake arrangement according to the third preferred embodiment of the present invention, shown in FIG. 26 taken along the line E—E of the same figure.

As will be appreciated best from FIG. 27, in the outboard engine 5 according to the third embodiment of the instant invention two sets of water intakes **29*a* and 29*b* are formed in the torpedo 6 in the vicinity of the annular suction passage formed by the groove 30. The water intakes 29*a* and 29*b* connect the annular groove 30** to the body of water in which the boat is being navigated.

The water intakes **29*a* and 29*b* are formed, as were the water intakes 29 of the first and second embodiments of the instant invention, at either side of the skeg 34 protruding at the lower side of the torpedo 6**.

The provision of the multiple water intakes **29*a* and 29*b* serves to ensure that if one of the suction passages water intakes should become clogged with floating matter during the operation of the engine, cooling water will still be taken into the cooling circuit of the engine freely through the remaining water intake. Thus, the engine will receive an ample supply of cooling water through the suction passage 22 defined in the lower case 7, without undue or excessive load on the water pump 9**.

In the third embodiment of the outboard engine according to the instant invention, it will be noted that the number of water intakes is increased and that the levels of the water intakes **29*b* are slightly higher than those 29 of the first and second embodiments. It will be further. be noted that when the outboard engine 5 is being operated in the high setting mode so as to facilitate the most efficient operation of the high performance super cavitation propeller 33 as depicted in FIG. 16, the level of the water surface 24 may be considerably below that of the top of the torpedo 6**.

Experiments have shown that by keeping the level of the water intakes below the center line defined by the axis of the propeller shaft 14, it is possible to ensure that the water intakes **29*a* and 29*b* will remain submerged even when the engine 5 is being operated in the high setting mode which facilitates the most efficient operation of the super cavitation propeller 33**.

Figure 28:
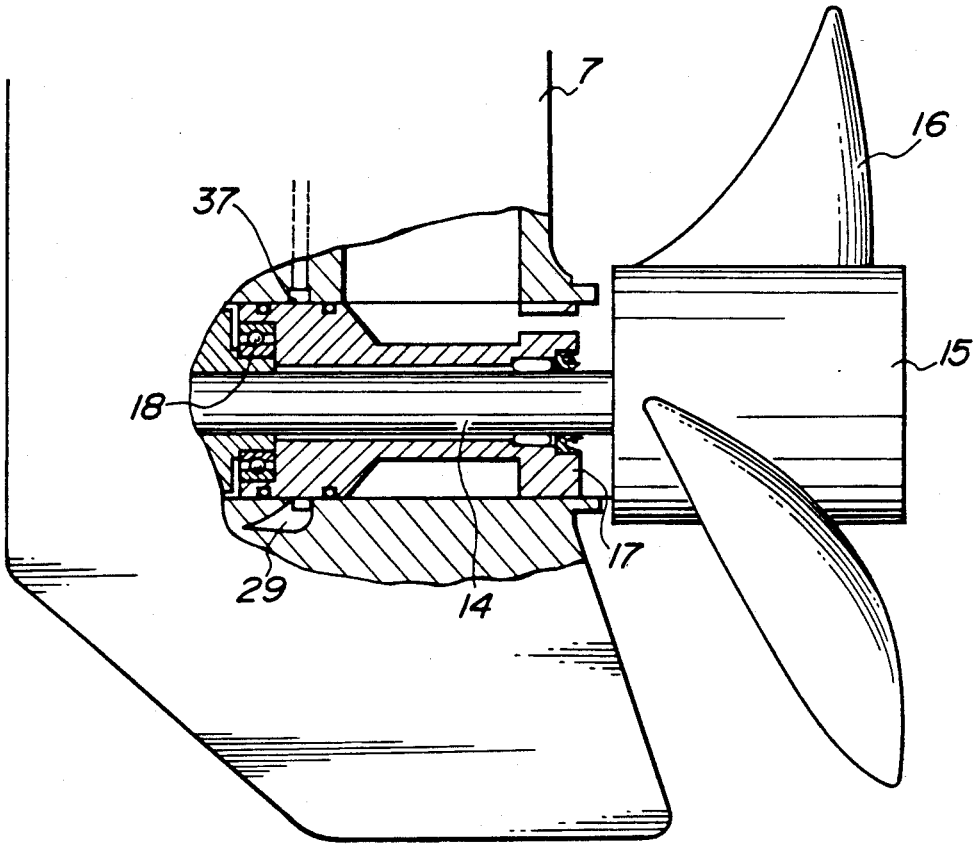
FIG. 28 is an enlarged partial cutaway side elevation view of the lower portion of the marine outboard engine formed with a water intake arrangement according to the fourth preferred embodiment of the present invention, showing the annular groove which forms part of the suction passage and its relationship to the other essential elements of the lower drive train.

Reference will now be made to FIG. 28 in which the lower portion of the fourth preferred embodiment of an outboard engine having a water intake system embodying the principles of the instant invention is depicted.

In the cooling water suction passage system formed in accordance with the third embodiment of the instant invention shown in FIG. 28, it will be noted that the annular groove 30 formed on the periphery of the bearing housing 17, in the first, second, and third embodiments of the instant invention has been omitted. In place of the annular groove formed on the periphery of the bearing housing 17 an annular groove 37 has been formed in the inner wall defining the peripheral surface of the cylindrical chamber 20 of the torpedo 6 formed at the lower end of the lower case 7.

The annular groove formed in the periphery of the cylinder walls defining the cylindrical chamber 20 performs essentially the same function as the annular groove provided in the periphery of the bearing housing 17 in the first, second, and third embodiments of the instant invention, in that it serves to connect the lower end of the suction passage 22 to the water intakes 29 formed at the lower side of the cylindrical section of the torpedo 6 so as to allow cooling water to be supplied to the cooling water circuit of the engine 5 through the suction passage 22.

Now reference will be made to FIGS. 29 and 30 in which the lower portion of the fifth preferred embodiment of an outboard engine having a water intake system embodying the principles of the instant invention is depicted.

Figure 29:
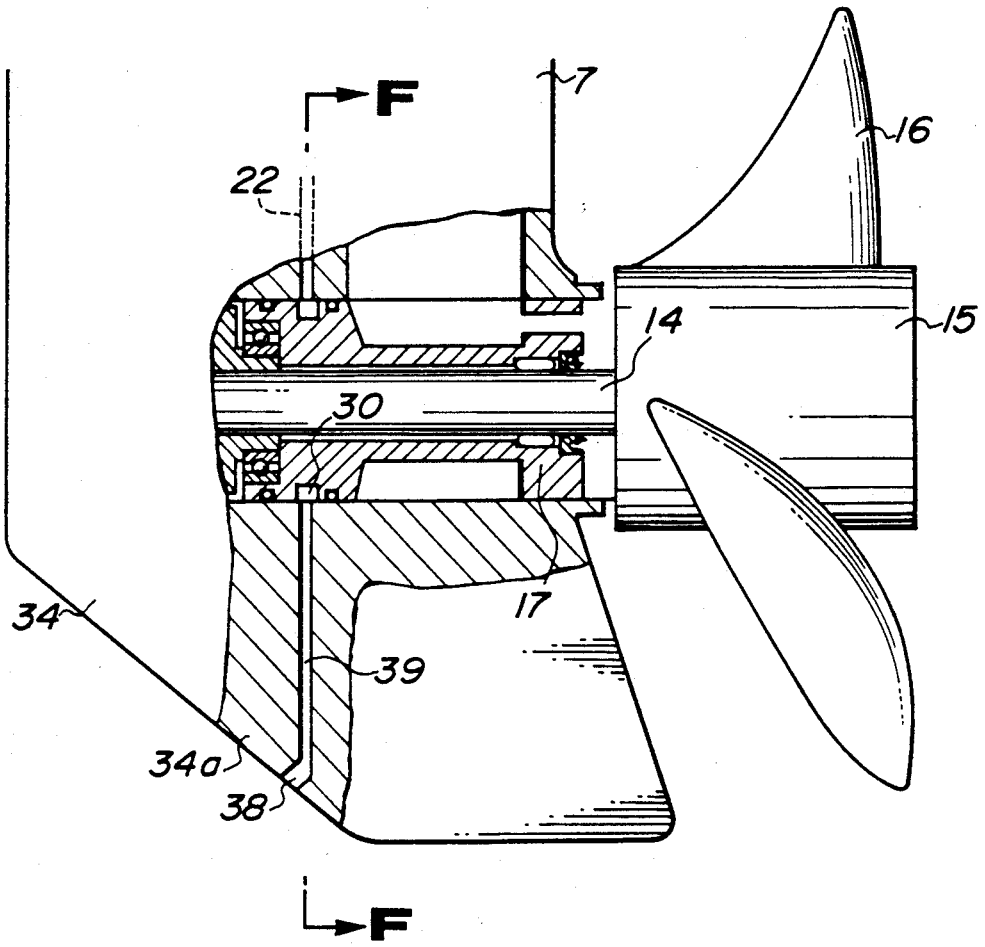
FIG. 29 is an enlarged partial cutaway side elevation view of the lower portion of the marine outboard engine formed with a water intake arrangement according to the fifth preferred embodiment of the present invention, showing the annular groove which forms part of the suction passage and its relationship to the other essential elements of the lower drive train.
Figure 30:
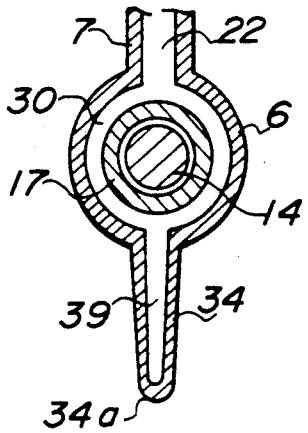
FIG. 30 is a cross-sectional view of the lower portion of the marine outboard engine formed with a water intake arrangement according to the fifth preferred embodiment of the present invention, shown in FIG. 29 taken along the line F—F of the same figure.

As will be appreciated from FIG. 29 the water intake 38 of the outboard engine 5 formed in accordance with the fifth embodiment of the instant invention is defined in the lower portion of the skeg at the leading edge **34*a* thereof. The water intake 38 formed on the leading edge 34*a* of the skeg 34 is connected to the annular groove 30 defined in the outer periphery of the bearing housing 17 by means of the suction passage 39**.

The fifth embodiment thus has an advantage over the first through fourth embodiments in that, the cooling water is drawn in through the water intake 38 which is at a considerably lower position than those 29 and **29*a* and 29*b*** of the previous embodiments.

The advantage of this position will be better appreciated when it is taken into consideration that the water intakes 29 and **29*a* and 29*b* are essentially located on the back side of torpedo 6 being dragged though the water at an oblique angle. Thus, there is, due to the fact that the water intake 29 is located on the back side of the cylinder with respect to its passage through the water, a tendency for a negative or reduced pressure to develop at the location of the water intake 29 thus increasing the load on the cooling water pump 9, is absent. There would be little or no tendency for the above mentioned negative pressure to develop at the position of the water intake 38 of the fifth embodiment of the instant invention since it is not immediately downstream of the torpedo 6**.

Thus, by locating the cooling water intake 38 at the lower portion of the leading edge 34*a* of the skeg 34 as in accordance with the fifth embodiment it becomes possible to draw cooling water through the water intake 38, through the annular suction passage formed by the groove 30 in the bearing housing 17 and into the suction passage 22 defined in the lower case 7 by means of the cooling water pump 9 with a minimum of exertion on the part of the cooling water pump 9 regardless of whether the operation mode of the outboard engine 5 is the shallow water mode, the high setting mode or the normal mode.

Figure 31:
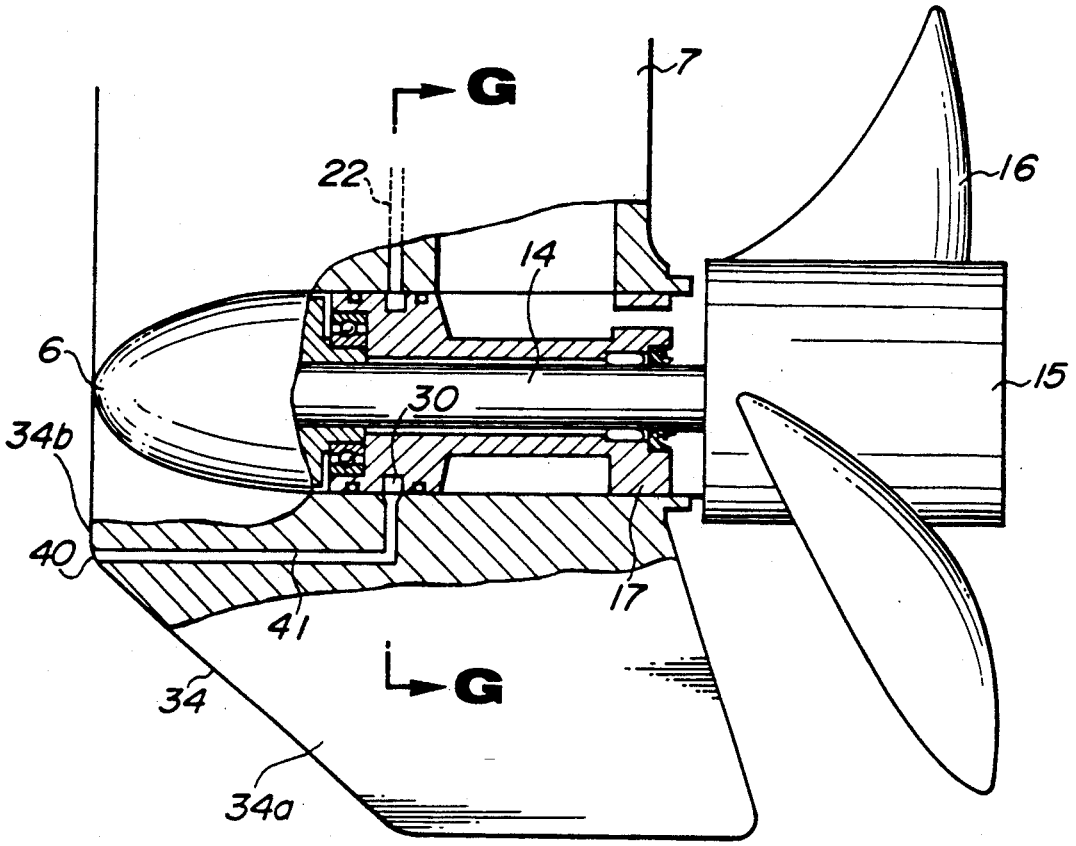
FIG. 31 is an enlarged partial cutaway side elevation view of the lower portion of the marine outboard engine formed with a water intake arrangement according to the sixth preferred embodiment of the present invention, showing the annular groove which forms part of the suction passage and its relationship to the other essential elements of the lower case.
Figure 32:
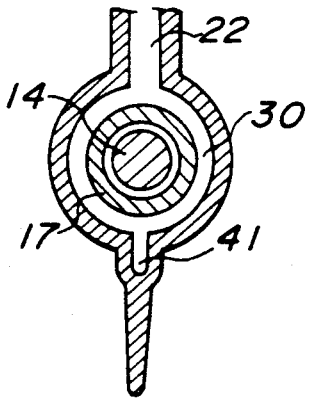
FIG. 32 is a cross-sectional view of the lower portion of the marine outboard engine formed with a water intake arrangement according to the sixth preferred embodiment of the present invention, shown in FIG. 31 and taken along the line G—G of the same figure.

Reference will now be made to FIGS. 31 and 32 in which the lower portion of the sixth preferred embodiment of an outboard engine having a water intake system embodying the principles of the instant invention is depicted.

As will be appreciated from FIG. 31, the water intake 40 of the outboard engine 5 formed in accordance with the sixth embodiment of the instant invention is defined at the front corner portion of the skeg 34 and at the corner defined between the top of the leading edge 34*a* of the front edge portion thereof and the straight vertical portion of the skeg 34 which defines a continuation of the vertical line defined by the front edge of the lower case train housing 7. The water intake 40 formed on the front leading edge 34*b* of the skeg 34 is connected to the annular groove 30 formed in the outer periphery of the bearing housing 17 by means of the suction passage 41.

Thus, like the fifth embodiment, the sixth embodiment also has the advantage over the first through fourth embodiments, that the cooling water is drawn in through the water intake 40 which is at a lower position than those 29 and 29*a* and 29*b* of the first through fourth embodiments.

In the sixth embodiment, the water intake is located in an area of the skeg 34 where there is no tendency for the action of the torpedo 6, as it is drawn through the water in the shallow water mode, to produce a reduced or negative water pressure. Further, it will be appreciated that the water intake 40 according to the sixth embodiment of the invention is located well in front of the turbulent area produced by the propeller.

Therefore, when the engine is operated shallow water mode as depicted in FIG. 17, upper corner portion of the front leading edge 34*b* of the skeg 34 as in the fifth embodiment with the water intake according to the sixth embodiment of the instant invention, it becomes possible to draw through the cooling water suction passage 41, through the portion of the suction passage formed by the annular groove 30 in the bearing housing 17 and into the suction passage 22 defined in the lower case 7, by means of the cooling water pump 9, with a minimum of exertion on the part of the cooling water pump 9, regardless of whether the operation mode of the outboard engine 5 is the shallow water mode, the high setting mode or the normal mode.

Thus, it will be appreciated by those skilled in the art of outboard and inboard.outboard engines that by providing a water intake in accordance with the principles set forth above in connection with the instant invention, it is possible to provide a cooling water induction system which can effectively and consistently supply cooling water to the engine regardless of whether the engine is being operated in the normal mode, the shallow water mode, or the high setting mode with a minimum of strain on the water pump.

It will be further appreciated from the above disclosure, that by providing on an outboard engine, a water intake formed in accordance with the principles of the instant invention, the risk of obstruction to the induction of cooling water into the engine due to floating matter such as vinyl sheet which may become caught on the lower case during the passage of the engine through the water, is minimized since the water intake is located at a portion of the engine on which it is difficult or impossible for such floating matter to cling.

Still a further advantage of the outboard engine water intake formed in accordance with the principles of the instant invention which will be readily apparent from the above disclosure is that, thanks to its deep disposition, the water intake formed according to the principles of the instant invention, remains submerged well beneath the surface of the water and the problem of the induction of air into the cooling water circuit through of the water intake is eliminated.

Still further it will be appreciated that the above advantages of the water intake formed in accordance with the principles of the instant invention are achieved without altering the overall dimensions of the torpedo. What is more, in addition to the fact that the dimensions as well as the streamlining configuration of the torpedo is preserved, there is no weight added to the lower portion of the engine and it is possible to preserve the optimum balance of the same.

Still a further advantage of the water intake system according to the instant invention, which will be apparent from the above disclosure to those skilled in the art, is that with the exception of two O-ring seals on the bearing housing the above advantages are realized without the introduction of new parts and that existing prior art engines can be easily modified at a minimum cost.

It will be understood that although only an outboard engine has been depicted for purposes of explanation, the water intake arrangements disclosed above may be applied equally well to inboard-outboard engines of the variety in which the power unit is mounted on engine mounts within the boat.

What is claimed is:

1. A marine engine having a cooling water circuit in which a cooling water pump is provided for pumping cooling water therethrough comprising:

a propeller shaft, said propeller shaft defining a propeller shaft axis;

a lower case, said lower case accommodating a bearing of said propeller shaft, said bearing allowing said propeller shaft to rotate therewithin about said axis, said lower case defining a chamber having a wall;

an annular passage defined within said lower case;

a cooling water suction passage, said cooling water suction passage being connected at one end thereof to an intake of said cooling water pump, said cooling water suction passage being connected at the other end thereof to said annular passage;

a first water intake which fluidly communicates with said annular passage, said first water intake being formed at a portion of said marine engine which is lower than said propeller shaft axis, for drawing water from a body of water in which a lower portion of said marine engine is immersed; and a second water intake for drawing water from said body of water which fluidly communicates with said cooling water suction passage, said second water intake being located above the level of said propeller shaft.

2. A marine engine as set forth in claim 1 wherein said chamber defined in said lower case is cylindrical.

3. A marine engine as set forth in claim 2 wherein said lower case includes a cylindrical bearing housing in which said bearing is disposed.

4. A marine engine as set forth in claim 3 wherein said annular passage is defined by an annular groove formed in said cylindrical bearing housing.

5. A marine engine as set forth in claim 3 wherein said annular passage is defined by an annular groove formed adjacent a cylindrical wall of said chamber.

6. A marine engine as set forth in claim 1 wherein said first water intake is located on a lower surface of said marine engine case.

7. A marine engine as set forth in claim 1 further comprising a removable cover, said removable cover being disposed over said second water intake in a manner to hermetically seal the same.

8. A marine engine which is adapted to be mounted on a stern member of a boat and immersed in a body of water in a manner which enables the engine to be turned about an axis so as to steer the boat comprising:

a lower case, a torpedo provided on a bottom portion of said lower case having a round front end and a rear end on which a propeller is mounted, said torpedo having a cylindrical chamber defined therein, a skeg extending from a lower surface of said torpedo along its center line, a cooling water circuit including a water pump for pumping cooling water therethrough, a pair of water intakes to said cooling water circuit formed on the lower surface of said torpedo on opposite sides of and adjacent said skeg at a location forward of the propeller and behind the rounded front end of said torpedo, a cylindrical bearing housing having a periphery which is disposed in engagement with a cylindrical wall of said cylindrical chamber of said torpedo, said cylindrical bearing housing having an axial bore through which a propeller shaft extends, a first end of said bearing housing being formed with a first annular recess in which a first propeller shaft bearing is disposed, a second end of said bearing housing being formed with a second annular recess in which a second propeller shaft bearing is disposed;

means defining a third annular recess in the outer periphery of said bearing housing, said third annular recess defining an exhaust chamber, the exhaust chamber fluidly communicating with an exhaust passage in said bearing housing;

an annular groove formed adjacent the periphery of the bearing housing, said annular groove providing fluid communication between said water inlets which are formed in the lower surface of said torpedo, and a water suction passage of the cooling water circuit; and a pair of O rings which are received in shallow grooves formed in said bearing housing on either side of said annular groove and which sealingly engage the cylindrical wall of said cylindrical chamber whereby the exhaust chamber is sealed from the cooling water circuit.

9. A marine engine according to claim 8 having a drive shaft for said propeller mounted in said lower case and located on a substantially vertical axis when said engine is mounted on the stern member in a lower position to drive the boat, and wherein said annular groove is located longitudinally spaced behind an extension of the drive shaft axis and said water circuit includes a passage connected between said annular groove and the water pump and extending parallel to the drive shaft axis.

10. A marine engine as claimed in claim 8 wherein said annular groove contains no moving parts.

11. A marine engine as claimed in claim 8 further comprising a seal member which is disposed in the second annular recess so as to prevent water from entering the axial bore, said seal member being located proximate the propeller.

12. A marine engine as set forth in claim 1 wherein said lower case includes a torpedo and said first water intake is located on a lower surface of said torpedo.

* * * * *

UNITED STATES PATENT AND TRADEMARK OFFICE

CERTIFICATE OF CORRECTION

PATENT NO. : 5,078,630

DATED : January 7, 1992

INVENTOR(S) : Takeshi Katsumata

It is certified that error appears in the above-identified patent and that said Letters Patent is hereby corrected as shown below:

Claim 8, column 15, line 38, change "round" to --rounded--.

Signed and Sealed this

Twentieth Day of April, 1993

*Attest:*

MICHAEL K. KIRK

*Attesting Officer*

*Acting Commissioner of Patents and Trademarks*